US005107125A

United States Patent [19]

Powell et al.

[11] Patent Number: 5,107,125

[45] Date of Patent: Apr. 21, 1992

[54] X-RAY IMAGING SCREEN WITH PROCESS FOR ITS PREPARATION

[75] Inventors: James J. Powell, Spencerport; Steven A. Lamy, Hamlin; Allen B. Cullen, Churchville, all of N.Y.

[73] Assignee: Eastman Kodak Company, Rochester, N.Y.

[21] Appl. No.: 665,116

[22] Filed: Mar. 6, 1991

[51] Int. Cl.[5] ..... G21K 4/00

[52] U.S. Cl. ..... 250/483.1; 250/484.1; 250/488.1; 427/53.1; 427/65; 427/160; 427/264; 427/289; 427/398.4; 427/407.1; 427/419.1

[58] Field of Search ..... 250/488.1, 487.1, 484.1 B, 250/483.1; 427/65, 53.1, 160, 264, 289, 398.4, 407.1, 419.1

[56] References Cited

U.S. PATENT DOCUMENTS

| | | | |
|---|---|---|---|
| Re. 31,847 | 3/1985 | Luckey | 250/327.2 |
| 2,573,200 | 10/1951 | Hushley | 501/79 |
| 3,855,035 | 12/1974 | Bates, Jr. et al. | 156/276 |
| 3,859,527 | 1/1975 | Luckey | 250/327.2 |
| 4,684,592 | 8/1987 | Matsuda et al. | 430/6 |
| 4,926,047 | 5/1990 | Takahashi et al. | 250/484.1 |
| 4,939,018 | 7/1990 | Kohda et al. | 428/192 |

OTHER PUBLICATIONS

*Research Disclosure*, Aug. 1979, vol. 184, Item #18431.

*Primary Examiner*—Constantine Hannaher
*Attorney, Agent, or Firm*—Carl O. Thomas

[57] ABSTRACT

An x-ray imaging screen is disclosed comprised of a thermoplastic film support having a planar coating surface and a fluorescent layer coated on that surface. The film support includes an integral lip at its outer boundary extending above the planar coating surface and along peripheral edge portions of the fluorescent layer to protect the fluorescent layer from wear and delamination from the film support. After coating the fluorescent layer on the planar surface of a film support in forming the screen, the coated film support is cut to size by locally heating the film support above its softening point. A softened portion of the film support is caused to flow over the peripheral edge of the fluorescent layer to form the integral lip while cooling the softened portion of the film support immobilizes the integral lip along the peripheral edge of the fluorescent layer, thereby providing a lateral protective buffer for the fluorescent layer along its peripheral edge.

22 Claims, 1 Drawing Sheet

X-RAY IMAGING SCREEN WITH PROCESS FOR ITS PREPARATION

FIELD OF THE INVENTION

The invention is directed to an X-ray imaging screen and to a process for its preparation.

BACKGROUND OF THE INVENTION

Photographic elements relying on silver halide emulsions for image recording have been recognized to possess outstanding sensitivity to light for more than a century. Roentgen discovered X-radiation by the inadvertent exposure of a silver halide photographic element. In 1913 the Eastman Kodak Company introduced its first product, a silver halide radiographic element, specifically intended to be exposed by X-radiation.

The utility of X-ray imaging as a medical diagnostic tool was immediately recognized, and the desirability of limiting patient exposure to X-radiation was also quickly appreciated. This led to the first X-ray imaging screens, specifically X-ray intensifying screens. These screens are constructed by coating a fluorescent layer on a support, usually a film support. The fluorescent layer is comprised of a mixture of phosphor particles and a binder. In use, an assembly is formed by mounting an intensifying screen with its fluorescent layer adjacent the silver halide emulsion layer of a radiographic element. An imagewise pattern of X-radiation striking the assembly is directly absorbed to a small degree by the silver halide emulsion layer. A much larger portion of the X-radiation is absorbed by the phosphor particles of the fluorescent layer. The phosphor particles promptly fluoresce at longer wavelengths which the silver halide emulsion layer can more readily absorb. A latent image is produced in the silver halide emulsion layer primarily attributable to fluorescence from the X-ray imaging screen. A summary of X-ray intensifying screens is found in *Research Disclosure*, Vol. 184, August 1979, Item 18431. *Research Disclosure* is published by Kenneth Mason Publications, Ltd., Dudley Annex, 21a North Street, Emsworth, Hampshire P010 7DQ, England.

Luckey U.S. Pat. No. 3,859,527 (reissued as U.S. Pat. No. Re. 31,847) proposed a second type of X-ray imaging screen, referred to as a storage phosphor screen to distinguish it from the X-ray intensifying screens described above. Storage phosphor screens can be essentially similar in construction to X-ray intensifying screens, differing primarily in the composition of the phosphor selected. Storage phosphor screens are imagewise exposed to X-radiation that is again absorbed by the phosphor particles. Although the phosphor may promptly fluoresce to some degree, most of the absorbed X-radiation energy is retained in the phosphor particles. When stimulated with longer wavelength radiation the screen emits in a third wavelength region of the spectrum. Typically X-ray imaging screens of the storage phosphor type are used alone for imaging—that is, these screens are not normally used to expose silver halide radiographic elements. Takahashi et al U.S. Pat. No. 4,926,047 is a recent example of the numerous patents that have sought to improve on Luckey.

Because of their structural and functional similarities X-ray imaging screens of both the intensifying screen and storage phosphor screen types encounter similar difficulties. The cost of X-ray imaging screens dictates that they be used repeatedly. To maximize their durability the screens are most commonly constructed using dimensionally stable polymeric films. Since the sharpest possible images are achieved with the thinnest possible fluorescent layer construction, the fluorescent layers are constructed with the minimum proportion of binder compatible with structural integrity—i.e., with a high weight ratio of phosphor particles to binder. To further protect the phosphor particles it is also conventional practice to coat a thin transparent film (commonly referred to as an overcoat) over the fluorescent layer.

In manufacturing scale construction a fluorescent layer containing phosphor particles and binder is coated on the planar coating surface of a continuous film as it is wound between storage rolls. To convert a wound roll of coated film into X-ray imaging screens the film is cut into convenient lengths. These cut lengths are then assembled into stacks, and the stacks are cut again to trim away edge areas, which are likely to contain coating irregularities. A third cutting step is usually undertaken to replace the corners with arcuate edges joining the perpendicular major edges. When cutting is undertaken by mechanical chopping, edge delamination (separation of the fluorescent layer form the film support) can occur.

When the X-ray imaging screens have been cut to size, the phosphor particles along the edges of the fluorescent layer are exposed. To protect the phosphor from degradation by exposure to contaminants it is common practice to seal the edges after cutting. The edge sealant can also be relied upon to physically protect the edges during handling in use. Thus, a series of cutting and sealing steps are conventionally employed to create an X-ray imaging screen from a fluorescent layer coated film roll.

A sectional detail of a conventional X-ray imaging screen 100 is shown in FIG. 1. A film support 101 is shown having a planar coating surface 103 bearing a fluorescent layer 105 which is in turn covered by a transparent protective overcoat 107. As shown the film support, fluorescent layer and overcoat have a common edge 109 produced by mechanical chopping. Flexing of the film support and fluorescent layer that occurs during mechanical chopping often results in areas of edge delamination, shown at 111. An edge sealant 113 applied in a post-chopping step is shown protecting the peripheral edge of the fluorescent layer that would otherwise be exposed.

SUMMARY OF THE INVENTION

In one aspect this invention is directed to an X-ray imaging screen comprised of a film support having a planar coating surface and, coated on the planar surface, a fluorescent layer comprised of a particulate phosphor capable of absorbing X-radiation and emitting longer wavelength electromagnetic radiation and a binder.

The X-ray imaging screen is characterized in that the film support is comprised of a thermoplastic polymer and includes an integral lip at its outer boundary extending above the planar coating surface and along peripheral edge portions of the fluorescent layer to protect the fluorescent layer from wear and delamination from the film support.

In another aspect this invention is directed to a process of preparing an X-ray imaging screen comprised of coating on a planar surface of a thermoplastic film support a fluorescent layer comprised of a particulate phosphor capable of absorbing X-radiation and emitting longer wavelength electromagnetic radiation and a binder, orienting the film support for sizing and cutting through the film support and fluorescent layer to define a peripheral edge of the imaging screen.

The process is characterized in that cutting to define the peripheral edge is achieved by locally heating the film support above its softening point, directing a softened portion of the film support over the peripheral edge of the fluorescent layer to form a peripheral lip integral with the film support, and cooling the softened portion of the film support to immobilize the integral peripheral lip along the peripheral edge of the fluorescent layer, thereby providing a lateral protective buffer for the fluorescent layer along its peripheral edge.

DESCRIPTION OF PREFERRED EMBODIMENTS

Figure 1:
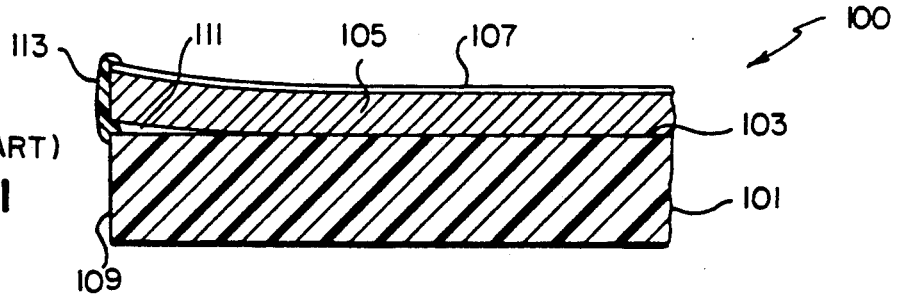
(PRIOR ART) FIG. 1
FIG. 1 is a sectional detail of a prior art X-ray imaging screen.
Figure 2:
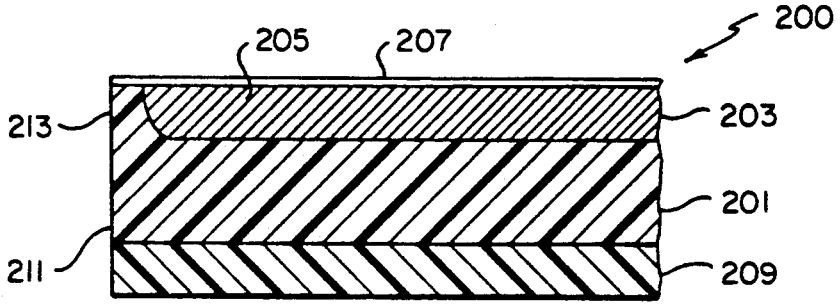
FIG. 2 is a sectional detail of an X-ray imaging screen satisfying the requirements of the invention.

In FIG. 2 a sectional detail of an X-ray imaging screen 200 according to the invention is illustrated. A thermoplastic film support 201 is shown having a planar coating surface 203 bearing a fluorescent layer 205 which is in turn covered by a transparent protective overcoat 207. On the major face of the film support opposite the planar coating surface an optional anticurl layer 209 is provided.

The film support and anticurl layer extend to a common peripheral edge 211 that circumscribes the screen. The film support has an integral lip 213 located adjacent its peripheral edge. The integral lip extends above the planar coating surface and laterally surrounds the fluorescent layer. The integral lip, film support and protective overcoat together entirely surround the fluorescent layer.

It is to be noted that in this construction the fluorescent layer is well protected along its peripheral edge from wear, delamination or other incidental physical damage. It is to be noted further that the presence of the integral lip obviates any requirement of providing a separate edge sealant. However, the use of an edge sealant similar to 113, although redundant, is not precluded. The integral lip can be thicker and therefore even more rugged than a conventional edge sealant layer. The integral lip is preferably of a height at least approximately corresponding to the thickness of the fluorescent layer. The upper extremity of the integral lip can be fused with the protective overcoat.

Figure 3:
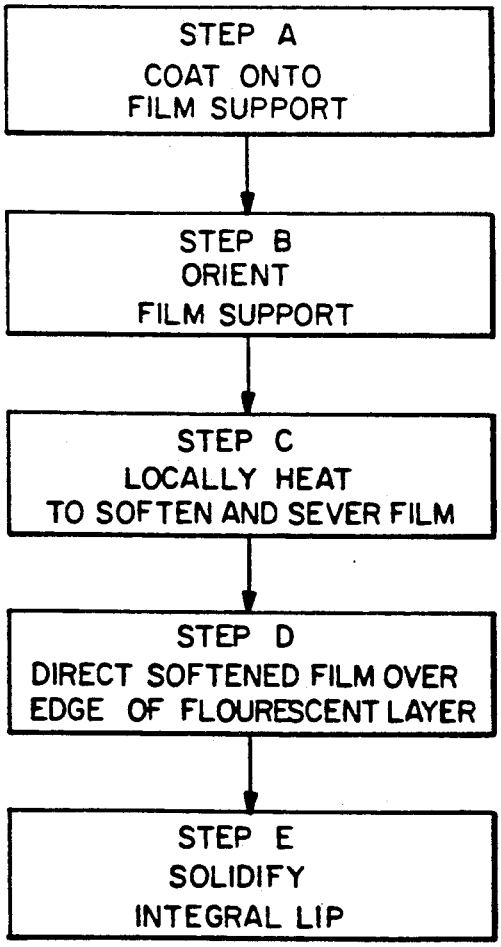
FIG. 3 is a schematic diagram of the step sequence of the process of the invention.

The process of preparing the X-ray imaging screens of the invention can best be appreciated by reference to FIG. 3, which diagrammatically indicates a preferred sequence of preparation steps.

In Step A a fluorescent layer of the type described above is coated onto a thermoplastic film support. A protective overcoat of the type described above is coated over the fluorescent layer. An anticurl layer, when included, can be coated either before or after the coating of the above layers. While any convenient conventional coating procedure can be employed, in manufacturing scale operations coating is typically conducted while winding the film support from one storage roll onto another.

In Step B an unsized film support coated with a fluorescent layer, a protective overcoat and, optionally, an anticurl layer is oriented for cutting, preferably with the film support overlying the fluorescent layer—i.e., inverted as compared to the orientation shown in FIG. 2. The lateral extent of the film support and the coatings oriented in this step can be of any dimension larger than the dimensions of the X-ray imaging screen.

The next step, Step C in FIG. 3, is to heat the film support along the peripheral edge of the X-ray imaging screen intended to be formed. The film support is formed of thermoplastic polymer and is heated along the peripheral edge to a temperature in excess of its softening temperature, preferably above or near its melting point. In this way the film support within the peripheral edge is readily structurally divided from the portion of the film support exterior of the peripheral edge. Although the thickness of the anticurl layer, fluorescent layer and overcoat have each been exaggerated for ease of visualization, in practice these layers are all much thinner than the film support and, in the absence of the film support, in themselves lack sufficient structural strength to join portions exterior and interior of the peripheral edge. Further, all of these layers are usually formed also of organic thermoplastic polymers that have softening and melting temperatures in the same general temperature ranges as the film support. Thus, the same localized heating step is capable of simultaneously cleaving all of these layers and the film support.

In Step D the softened mass of the film support along its peripheral edge is caused to flow over the peripheral edge of the fluorescent layer to create the integral lip portion of the film support. In the preferred orientation, with the film support overlying the fluorescent layer, when the softened film support exhibits a sufficiently low viscosity, which is in turn a function of the thermoplastic polymer or polymers chosen and the temperature to which it is heated, gravity alone can provide a sufficient driving force to cause the downward peripheral flow of the softened film support.

It is also possible to supplement the gravitational driving force by applying a physical force. A preferred technique for applying a physical force is to direct a fluid jet downwardly against the softened portion of the film support. Any chemically compatible fluid can be employed. Since phosphors are often sensitive to water and/or very low concentrations of liquid borne impurity ions, it is preferred to direct a gaseous jet downwardly against the softened film support. Using a fluid jet as opposed to a solid shaping tool contacting the softened film support has the advantage that there is no possibility of adhesion, as can occur with a solid shaping tool, and, additionally, the risk of edge contamination that can result from using a solid shaping tool is also avoided.

By directing the fluid jet downwardly it is achieving a downward flow of the softened film support that is assisted by gravity. In many instances gravity alone is sufficient to produce the downward flow of the softened film support required to form the integral lip. In some instances, if the film support is softened to the point of exhibiting a very low viscosity, it can be advantageous to direct the fluid jet upward so that it assists in holding the softened film support in its desired position along the outer boundary of the fluorescent layer.

It is possible to form the integral lip with the film support and layers oriented as shown in FIG. 2—that is, with the fluorescent layer overlying the film support. In this instance the force directing the softened peripheral portion of the film support to form the integral lip must act against gravity tending to cause the softened portion of the film support to move away from the fluorescent layer. Thus, if a fluid jet is employed, it must be increased in force as compared to that used with the inverted arrangement described above. For this reason the orientation rather than that shown in FIG. 2 is preferred for forming the integral lip.

Once the softened portion of the film support has flowed to the desired location to form the peripheral integral lip the next step is to solidify the integral lip, as indicated by Step E in FIG. 3. Advantageously the same fluid jet that is employed to direct the softened film support around the edge of the fluorescent layer can also be used to cool and solidify softened film support in position as a peripheral integral lip. When the fluid jet impinges on the softened portion of the film support, it will direct the softened portion to the desired physical location while simultaneously extracting heat. Since the expansion that occurs when fluid is passed through a nozzle in itself cools the fluid, the mere act of forming an impinging fluid stream can in itself provide both the physical driving force and the cooling required to direct and immobilize the peripheral portion of the film support.

While the use of a single fluid jet for both directing and immobilizing the peripheral portion of the film support is preferred as being the simplest and most convenient approach to performing these functions, it is appreciated that the step of directing the softened film into position to form the integral lip and the step of immobilization can be separated and performed separately, with both, either one or neither of these two steps being performed with a fluid jet. For example, one fluid jet at or only slightly below ambient temperatures can be used to direct the softened portion of the film support while a second following fluid jet of a much lower temperature can be used to chill set the integral lip. Instead of using a fluid jet for cooling any conventional quenching technique can be substituted that is not chemically incompatible with the performance properties of the fluorescent layer. Further, it is appreciated that cooling is not the only technique available for immobilizing the integral lip. Chemical hardening techniques, such as those conventionally employed in the crosslinking of organic polymers, can be used alternatively to immobilize the integral lip in its intended location.

Film supports constructed of thermoplastic polymers contemplated for use in the practice of the invention can be selected from a wide array of film supports demonstrated to be suited for the construction of X-ray imaging screens and silver halide radiographic elements. Typical useful thermoplastic film supports include films of cellulose nitrate and cellulose esters such as cellulose triacetate and diacetate, polystyrene, polyamides, homo- and copolymers of vinyl chloride, poly(vinyl acetal), polycarbonate, homo- and copolymers of olefins such as polyethylene and polypropylene, and polyesters of dibasic aromatic carboxylic acids with divalent alcohols such as poly(ethylene terephthalate).

Because of their superior dimensional stability the latter polyesters constitute particularly preferred thermoplastic film supports. Preferred polyester film supports are comprised of linear polyester such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,446. Polyester films can be formed by varied techniques as illustrated by Alles, cited above, Czerkas et al U.S. Pat. No. 3,663,683 and Williams et al U.S. Pat. No. 3,504,075, and modified for use as radiographic film supports by subbing, etc., as illustrated by VanStappen U.S. Pat. No. 3,227,576, Nadeau et al U.S. Pat. Nos. 3,143,421 and 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420, Malinson et al U.S. Pat. No. 3,928,697, Van Paesschen et al U.S. Pat. No. 4,132,552, Schrader et al U.S. Pat. No. 4,141,735, McGrail et al U.S. Pat. No. 4,594,262, and Bayless et al U.S. Pat. No. 4,645,731.

These and other suitable thermoplastic film supports are disclosed in *Research Disclosure*, Item 18431, Section IX, cited above, and *Research Disclosure*, Vol. 308, December 1989, Item 308119, the disclosures of which are here incorporated by reference. The thermoplastic film supports can be of any conventional thickness, but are typically in the form of flexible sheets having thicknesses of up to about 2 mm.

The fluorescent layer coated on the film support is comprised of a mixture of phosphor particles and a binder. When the X-ray imaging screen is intended to be used as an intensifying screen, any conventional phosphor known to be useful for this purpose can be employed. Such phosphors are illustrated by those disclosed in *Research Disclosure*, Item 18431, Section IX, cited above and here incorporated by reference.

Preferred prompt emission phosphors include calcium tungstate ($CaWO_4$); niobium and/or rare earth activated yttrium, lutetium, and gadolinium tantalates; rare earth activated mixed alkaline earth sulfates; titanium activated hafnia and/or zirconia; and rare earth activated rare earth oxychalcogenides and halides. The rare earth oxychalcogenide and halide phosphors are preferably chosen from among those of the formula:

$$M_{(w-n)}M'_nO_wX$$

wherein:

M is at least one of the metals yttrium, lanthanum, gadolinium, or lutetium,

M' is at least one of the rare earth metals, preferably dysprosium, erbium, europium, holmium, neodymium, praseodymium, samarium, terbium, thulium, or ytterbium, X is a middle chalcogen (S, Se, or Te) or halogen, n is 0.0002 to 0.2, and w is 1 when X is halogen or 2 when X is chalcogen.

Calcium tungstate phosphors are illustrated by Wyand et al U.S. Pat. No. 2,303,942. Niobium activated and rare earth activated yttrium, lutetium, and gadolinium tantalates are illustrated by Brixner U.S. Pat. No. 4,225,653. Rare earth activated gadolinium and yttrium middle chalcogen phosphors are illustrated by Royce U.S. Pat. No. 3,418,246. Rare earth-activated lanthanum and lutetium middle chalcogen phosphors are illustrated by Yocom U.S. Pat. No. 3,418,247. Terbium activated lanthanum, gadolinium, and lutetium oxysulfide phosphors are illustrated by Buchanan et al U.S. Pat. No. 3,725,704. Cerium activated lanthanum oxychloride phosphors are disclosed by Swindells U.S. Pat. No. 2,729,604. Terbium activated and optionally cerium activated lanthanum and gadolinium oxyhalide phosphors are disclosed by Rabatin U.S. Pat. No. 3,617,743 and Ferri et al U.S. Pat. No. 3,974,389. Rare earth activated rare earth oxyhalide phosphors are illustrated by Rabatin U.S. Pat. Nos. 3,591,516 and 3,607,770. Terbium-activated and ytterbium-activated rare earth oxyhalide phosphors are disclosed by Rabatin U.S. Pat. No. 3,666,676. Thulium-activated lanthanum oxychloride or oxybromide phosphors are illustrated by Rabatin U.S. Pat. No. 3,795,814. A $(Y,Gd)_2O_2S:Tb$ phosphor wherein the ratio of yttrium to gadolinium is between 93:7 and 97:3 is illustrated by Yale U.S. Pat. No. 4,405,691. Non-rare earth coactivators can be employed, as illustrated by bismuth and ytterbium activated lanthanum oxychloride phosphors disclosed in Luckey et al U.S. Pat. No. 4,311,487. Rare earth activated mixed alkaline earth sulfate phosphors are illustrated by Luckey U.S. Pat. No. 3,650,976. Titanium activated hafnia and/or zirconia phosphors are illustrated by Bryan et al U.S. Pat. Nos. 4,963,753, 4,963,754, 4,961,004, 4,967,087, 4,972,085, 4,967,085, 4,980,559, 4,980,560, 4,983,847 and 4,988,880.

The mixing of phosphors as well as the coating of phosphors in separate layers of the same screen are specifically recognized. A phosphor mixture of calcium tungstate and yttrium tantalate is illustrated by Patten U.S. Pat. No. 4,387,141. However, in general neither mixtures nor multiple phosphor layers within a single screen are preferred or required.

When the X-ray imaging screens are intended to used as storage phosphor screens, the particulate phosphors can take any of the forms disclosed by Luckey U.S. Pat. No. 3,859,527 (reissued as U.S. Pat. No. Re. 31,847), cited above and here incorporated by reference. Preferred stimulable storage phosphors are rare earth activated barium fluorohalide phosphors Exemplary phosphors of this type are disclosed by U.K. Patent 1,419,169, Ferretti U.S. Pat. Nos. 4,080,306 and 4,524,071, Aoki et al U.S. Pat. No. 4,109,152, Mori et al U.S. Pat. No. 4,138,529, Kotera et al U.S. Pat. Nos. 4,239,968, 4,261,854, 4,258,264, 4,239,968, 4,512,911, 4,889,996 and 4,978,472, Takahashi et al U.S. Pat. Nos. 4,368,390, 4,380,702, 4,394,581, 4,535,237, 4,535,238, 4,876,161, 4,894,548, 4,895,772, and 4,926,047, Nishimora et al U.S. Pat. No. 4,336,154, Nakamura et al U.S. Pat. Nos. 4,532,071, 4,605,861, 4,698,508, 4,835,398 and 4,891,227, Umemoto et al U.S. Pat. No. 4,505,889, Takahara et al U.S. Pat. No. 4,515,706, Arakawa et al U.S. Pat. No. 4,534,884, Miyahara et U.S. Pat. No. 4,539,138, Degenhardt U.S. Pat. No. 4,587,036, and Katoh et al U.S. Pat. No. 4,871,474. Other stimulable storage phosphor compositions are, of course, known, as illustrated by Ackerman U.S. Pat. No. 4,496,844, the disclosures of which are here incorporated by reference.

The phosphors, whether applied to intensifying screen or storage phosphor screen use, can be used in any conventional particle size range and distribution. It is generally appreciated that sharper images are realized with smaller mean particle sizes, but light emission efficiency declines with decreasing particle size. Thus, the optimum mean particle size for a given application is a reflection of the balance between imaging speed and image sharpness desired. Conventional phosphor particle size ranges and distributions are illustrated in the phosphor teachings cited above.

The fluorescent layer includes in addition to the phosphor particles sufficient binder to give structural coherence to the fluorescent layer. In general the binders useful in the practice of the invention are those conventionally employed in the art. Binders are generally chosen from a wide variety of known organic polymers which are transparent to X-radiation and emitted light. Preferred binders are, like the film support, chosen from among thermoplastic polymers. Binders commonly employed in the art include sodium o-sulfobenzaldehye acetal of poly(vinyl alcohol); chlorosulfonated poly(ethylene); a mixture of macromolecular bisphenol poly(carbonates) and copolymers comprising bisphenol carbonates and poly(alkylene oxides); aqueous ethanol soluble nylons; poly(alkyl acrylates and methacrylates) and copolymers of poly(alkyl acrylates and methacrylates with acrylic and methacrylic acid); poly(vinyl butyral); and poly(urethane) elastomers. These and other useful binders are disclosed in U.S. Pat. Nos. 2,502,529; 2,887,379; 3,617,285; 3,300,310; 3,300,311; and 3,743,833; and in *Research Disclosure*, Vol. 154, February 1977, Item 15444, and Vol. 182, June 1979. *Research Disclosure* is published by Kenneth Mason Publications, Ltd., Emsworth, Hampshire P010 7DD, England. Particularly preferred binders are poly(urethanes), such as those commercially available under the trademark Estane from Goodrich Chemical Co., the trademark Permuthane from the Permuthane Division of Beatrice Foods Co., and the trademark Cargill from Cargill, Inc.

Any conventional ratio of phosphor to binder can be employed. Depending upon the specific imaging application and phosphor to binder weight ratios of from 1:1 to 40:1 or higher are feasible. Generally thinner phosphor layers and sharper images are realized when a high weight ratio of phosphor to binder is employed. The best balance between structural integrity and image sharpness is obtained with a phosphor to binder weight ratio in the range of from 10:1 to 25:1 and are preferred. When constructed within contemplated phosphor to binder ratios noted above the thickness of the fluorescent layer can range from about 50 to 500 μm, most preferably from about 75 to 300 μm, in thickness.

In those instances in which it is desired to reduce the effective thickness of a phosphor layer below its actual thickness the phosphor layer is modified to impart a small, but significant degree of light absorption. If the binder is chosen to exhibit the desired degree of light absorption, then no other ingredient of the phosphor layer is required to perform the light attenuation function. For example, a slightly yellow transparent polymer will absorb a significant fraction of phosphor emitted blue light. Ultraviolet absorption can be similarly achieved. It is specifically noted that the less structurally complex chromophores for ultraviolet absorption particularly lend themselves to incorporation in polymers.

In most instances a separate absorber is incorporated in the phosphor layer to reduce its effective thickness. The absorber can be a dye or pigment capable of absorbing light within the spectrum emitted by the phosphor. Yellow dye or pigment selectively absorbs blue light emissions and is particularly useful with a blue emitting phosphor. On the other hand, a green emitting phosphor is better used in combination with magenta dyes or pigments. Ultraviolet emitting phosphors can be used with known ultraviolet absorbers. Black dyes and pigments are, of course, generally useful with phosphors, because of their broad absorption spectra. Carbon black is a preferred light absorber for incorporation in the phosphor layers. Luckey and Cleare U.S. Pat. No. 4,259,588, here incorporated by reference, teaches that increased sharpness (primarily attributable to reduced crossover, discussed below) can be achieved by incorporating a yellow dye in a terbium-activated gadolinium oxysulfide phosphor layer.

An overcoat, though not required, is commonly located over the fluorescent layer for humidity and wear protection. The overcoat can be chosen using the criteria described above for the binder. The overcoat can be chosen from among the same polymers used to form either the binder or the support, with the requirements of toughness and scratch resistance usually favoring polymers conventionally employed for film supports. For example, cellulose acetate is a preferred overcoat used with the preferred poly(urethane) binders. Overcoat polymers are often used also to seal the edges of the fluorescent layer and can be used for this purpose in the X-ray imaging screens of this invention.

While anticurl layers are not required for the screens, they are generally preferred for inclusion. The function of the anticurl layer is to balance the forces exerted by the layers coated on the opposite major surface of the screen support which, if left unchecked, cause the screen to assume a non-planar configuration—e.g., to curl or roll up on itself. Materials forming the anticurl layers can be chosen from among those identified above for use as binders and overcoats. Generally an anticurl layer is formed of the same polymer as the overcoat on the opposite side of the support. For example, cellulose acetate is preferred for both overcoat and anticurl layers.

To prevent blocking, such as the adhesion that can occur on a storage roll or upon contact with a radiographic element or other smooth surface, the overcoats of the fluorescent layers can include a matting agent. Useful matting agents are illustrated by those disclosed in *Research Disclosure*, Item 308119 cited above, Section XVI. A variety of other optional materials can be included in the surface coatings of the X-ray imaging screens, such as materials to reduce static electrical charge accumulation, plasticizers, lubricants, and the like.

While the entire peripheral edge of the X-ray imaging screen can be simultaneously heated during the cutting to size step, it is generally most convenient to confine local heating to a single spot that is then guided along the peripheral edge, usually in a fixed spatial relationship to the fluid jet or jets described above, until the entire screen has been circumscribed. A laser beam is excellently suited for performing this operation. Generally any conventional laser having a sufficient power output capability to raise a spot on the coated film support above its softening temperature, preferably to a temperature at or near its melting point, can be employed.

To facilitate transfer of laser beam energy to the film support, it is preferred that the film support be constructed to exhibit a high absorption of electromagnetic radiation at the wavelength of the laser beam. Stated quantitatively, the film support preferably exhibits an optical density to electromagnetic radiation corresponding to the wavelength of the laser beam. Fortuitously the absorption level of the film support is satisfied by the common practice of loading dye and/or pigment into the film support for the purpose of improving image sharpness. A conventional practice in constructing high definition X-ray imaging screens is to load a black dye or pigment, most commonly carbon black, into the polymer forming the film support. Such film supports are excellently suited for laser sizing. The broad absorption band of carbon black throughout the visible spectrum allows a broad choice of specific lasers.

In some applications for highest attainable imaging speeds are favored over image sharpness. In such applications it is common practice to load into the film support reflective materials, such as titania pigment, or include in the support microvoids to reflect or scatter radiation, as illustrated by Roberts et al U.S. Pat. No. 4,912,333. Reflective film supports are not incompatible with laser cleaving, although absorption levels are significantly reduced. It is recognized that by choosing laser wavelengths in the ultraviolet or near infrared portions of the spectrum and incorporating in or on the film support an infrared absorbing dye or ultraviolet absorber the efficiency of laser beam absorption can be increased without significantly reducing support reflectance in the visible spectrum. Illustrative ultraviolet and infrared absorbers are disclosed in Research Disclosure, Item 308119, cited above, Section VIII-C, the disclosure of which is here incorporated by reference.

The binder for the fluorescent layer, the overcoat and the anticurl layer are usually transparent. These layers are sufficiently thin that they can be heated adequately heat transfer from the film support even if little, if any, of the laser energy is directly absorbed. In high definition X-ray imaging screens it is common practice to incorporate small amounts of dye and/or pigment in the fluorescent layer binder to enhance image sharpness. When present the dye and/or pigment can function to facilitate laser heating as well.

EXAMPLES

The invention can be better appreciated by reference to the following specific illustration:

Europium activated barium fluorobromide phosphor particles having a mean diameter of 18 μm were mixed with Permuthane TM polyurethane binder in a phosphor to binder weight ratio of 17:1 with the polyurethane suspended in a 92.7:7.3 weight ratio mixture of methylene chloride and methanol. The phosphor and binder containing composition so formed was coated onto a planar surface of a poly(ethylene terephthalate) film support. The methylene chloride and methanol mixture was then removed by evaporation to leave a fluorescent layer on the film support having a thickness of 178 μm (7 mils). Over the fluorescent layer was coated a transparent cellulose acetate protective overcoat having a thickness of 7.6 μm (0.3 mils).

The poly(ethylene terephthalate) film support had a thickness of 178 μm (7 mils) and contained sufficient carbon black particles to render the film support black in appearance and opaque to visible light.

The coated film support was mounted on a X-Y addressing table of a 50 watt carbon dioxide laser with the film support positioned to overlie the fluorescent layer. The laser beam was directed vertically downwardly and focused to a spot of approximately 178 μm (7 mils) in diameter, resulting in immediate softening of the film support and cleavage of the film support and associated layers in this spot. Simultaneously a jet of air of was directed downwardly in the area of the laser spot. Movement of the X-Y addressing table resulted in forming an X-ray imaging screen having circumscribed by peripheral edge of the configuration shown in FIG. 2. Microscopic examination of the peripheral edge revealed that an integral lip had been formed on the film support with a width extending inwardly from the periphery of the screen from 75 to 125 μm.

Examination of the X-ray imaging screen revealed no evidence of edge delamination or other physical imperfections in the screen edge.

The invention has been described in detail with particular reference to preferred embodiments thereof, but it will be understood that variations and modifications can be effected within the spirit and scope of the invention.

What is claimed is:

1. An X-ray imaging screen comprising
a film support having a planar coating surface and,
coated on the planar surface, a fluorescent layer comprised of
a particulate phosphor capable of absorbing X-radiation and emitting longer wavelength electromagnetic radiation and
a binder
characterized in that
the film support consists of a one piece thermoplastic polymer element that includes an integral lip at its outer boundary extending above the planar coating surface and along peripheral edge portions of the fluorescent layer to protect the fluorescent layer from wear and delamination from the film support.

2. An X-ray imaging screen according to claim 1 further characterized in that a transparent overcoat overlies the fluorescent layer and is fused with the lip along its periphery so that the film support, its lip and the transparent layer together surround the fluorescent layer.

3. An X-ray imaging screen according to claim 1 further characterized in that the weight ratio of phosphor to binder is in the range of from 1:1 to 40:1.

4. An X-ray imaging screen according to claim 3 further characterized in that the weight ratio of phosphor to binder is in the range of from 10:1 to 25:1.

5. An X-ray imaging screen according to claim 1 further characterized in that the support includes an anticurl layer located on a major surface opposite the planar coating surface.

6. An X-ray imaging screen according to claim 1 further characterized in that the phosphor is a storage phosphor capable of absorbing X-radiation and emitting longer wavelength electromagnetic radiation when subsequently stimulated.

7. An X-ray imaging screen according to claim 6 further characterized in that the phosphor is a rare earth activated barium fluorohalide storage phosphor.

8. An X-ray imaging screen according to claim 1 further characterized in that the phosphor is chosen to emit longer wavelength electromagnetic radiation promptly upon absorption of X-radiation.

9. An X-ray imaging screen according to claim 8 further characterized in that the phosphor is chosen from the class consisting of calcium tungstate; rare earth activated mixed alkaline earth sulfates; niobium or rare earth activated yttrium, lutetium and gadolinium tantalates; titanium activated hafnia and/or zirconia; and rare earth activated rare earth oxychalcogenides and halides.

10. An X-ray imaging screen according to claim 1 further characterized in that the binder is a polyurethane.

11. An X-ray imaging screen according to claim 1 further characterized in that the thermoplastic polymer is poly(ethylene terephthalate).

12. A process of preparing an X-ray imaging screen comprised of
coating on a planar surface of a thermoplastic polymer film support a fluorescent layer comprised of a particulate phosphor capable of absorbing X-radiation and emitting longer wavelength electromagnetic radiation and a binder,
orienting the film support for sizing and
cutting through the film support and fluorescent layer to define a peripheral edge of the imaging screen,
characterized in that
cutting to define the peripheral edge is achieved by locally heating the film support above its softening point,
directing a softened portion of the film support over the peripheral edge of the fluorescent layer to form a peripheral lip integral with the film support, and
cooling the softened portion of the film support to immobilize the integral lip along the peripheral edge of the fluorescent layer, thereby providing a lateral protective buffer for the fluorescent layer along its peripheral edge.

13. A process according to claim 12 further characterized in that a laser is employed to heat the film support locally above its softening point.

14. A process according to claim 13 further characterized in that the film support exhibits an optical density in excess of 4.0 at the wavelength of laser emission.

15. A process according to claim 12 further characterized in that a fluid stream directed to impinge upon the softened portion of the film support.

16. A process according to claim 15 further characterized in that a nonreactive gas is employed to provide the fluid stream.

17. A process according to claim 15 further characterized in that the fluid stream is employed to cool the softened portion of the film support forming the peripheral lip.

18. A process according to claim 15 further characterized in that the fluid stream is employed to direct the softened portion of the film support over the peripheral edge of the fluorescent layer.

19. A process according to claim 12 further characterized in that prior to cutting the imaging screen is oriented with the film support overlying the fluorescent layer.

20. A process according to claim 19 further characterized in that a fluid stream is directed downwardly to assist the softened film support in covering the peripheral edge of the fluorescent layer.

21. A process according to claim 20 further characterized in the fluid stream is below the temperature of the softened portion of the film support and acts to accelerate cooling of the softened portion of the film support to form the integral lip.

22. An X-ray imaging screen comprising
a film support having a planar coating surface and,
coated on the planar surface, a fluorescent layer comprised of
a particulate phosphor capable of absorbing X-radiation and emitting longer wavelength electromagnetic radiation and
a binder
characterized in that
the film support consists of a one piece thermoplastic poly(ethylene terephthalate) polymer element that includes an integral lip at its outer boundary extending above the planar coating surface formed by flowing a softened portion of the support along peripheral edge portions of the fluorescent layer to protect the fluorescent layer from wear and delamination from the film support.

* * * * *